US006345616B1

(12) United States Patent
Umahashi

(10) Patent No.: US 6,345,616 B1
(45) Date of Patent: Feb. 12, 2002

(54) CUTTING MACHINE

(75) Inventor: Takayuki Umahashi, Tokyo (JP)

(73) Assignee: Disco Corporation, Tokyo (JP)

( * ) Notice: Subject to any disclaimer, the term of this patent is extended or adjusted under 35 U.S.C. 154(b) by 9 days.

(21) Appl. No.: 09/597,255

(22) Filed: Jun. 19, 2000

(30) Foreign Application Priority Data

Jun. 21, 1999 (JP) ..... 11-174076

(51) Int. Cl.[7] ..... B28D 1/04

(52) U.S. Cl. ..... 125/13.01; 125/13.01; 125/14; 125/23.01; 457/67; 83/425.2

(58) Field of Search ..... 125/13.01, 12, 125/14, 23.01, 13.02, 15; 451/5, 8, 9, 67, 10, 11, 41; 83/76.8, 79, 80, 100, 107, 425.2, 471.3

(56) References Cited

U.S. PATENT DOCUMENTS 4,407,262 A * 10/1983 Wirz et al. ..... 125/13.01
4,688,540 A * 8/1987 Ono ..... 125/13.01
5,842,461 A * 12/1998 Azuma ..... 125/13.01
6,102,023 A * 8/2000 Ishiwata et al. ..... 125/13.01
6,142,138 A * 11/2000 Azuma et al. ..... 125/14

FOREIGN PATENT DOCUMENTS

JP 11-26402 * 1/1999 ..... 125/13.01
JP 11-74228 * 3/1999 ..... 125/13.01

* cited by examiner

*Primary Examiner*—George Nguyen
(74) *Attorney, Agent, or Firm*—Smith, Gambrell & Russell, LLP

(57) ABSTRACT

A cutting machine comprising cassette supporting means, disposed in a cassette bearing area, for supporting a cassette accommodating a plurality of workpieces; a chuck table disposed substantially horizontally movably between a chucking area and a cutting area; cleaning means disposed in a cleaning area; cutting means for cutting the workpiece chucked on the chuck table located in the cutting area; and workpiece transport means. The cassette bearing area, the chucking area, and the cleaning area are placed in this order on a first straight line extending in a predetermined direction. The chucking area and the cutting area are placed on a second straight line extending substantially perpendicularly to the first straight line.

7 Claims, 3 Drawing Sheets

CUTTING MACHINE

FIELD OF THE INVENTION

This invention relates to a cutting machine, such as a dicer for dicing a semiconductor wafer.

DESCRIPTION OF THE PRIOR ART

Japanese Unexamined Patent Publication Nos. 1999-26402 and 1999-74228 each disclose a dicer for cutting a semiconductor wafer along cutting lines arranged in a lattice pattern, i.e., for dicing the semiconductor wafer. In the dicer, a cassette bearing area, a waiting area, a chucking area, a cutting area, and a cleaning area are placed. Cassette supporting means is disposed in the cassette bearing area, temporally supporting means is disposed in the waiting area, and cleaning means is disposed in the cleaning area. The dicer also has a chuck table disposed substantially horizontally movably between the chucking area and the cutting area, cutting means for dicing a workpiece chucked onto the chuck table located in the cutting area, and first transport means, second transport means, and third transport means. On the cassette supporting means, a cassette is borne which accommodates a plurality of workpieces, more detailedly, semiconductor wafers mounted in a central opening of a frame via a mounting tape. The workpiece in the cassette is carried out of the cassette onto the temporally supporting means by the first transport means. Then, the workpiece is transported to the chucking area by the second transport means, and chucked onto the chuck table. The workpiece is moved, together with the chuck table, to the cutting area, where the workpiece is diced by the cutting means. Then, the diced product is moved, together with the chuck table, to the chucking area, whereafter the product is transported from the chuck table to the cleaning area by the third transport means. Then, the product is cleaned by the cleaning means in the cleaning area, and transported from the cleaning area onto the temporally supporting means by the second transport means. Then, the product is carried from the site on the temporally supporting means into the cassette by the first transport means.

The conventional dicer described above poses the problem that the relative arrangement of the cassette bearing area, the waiting area, the chucking area, the cutting area, and the cleaning area is not necessarily rational, so that the entire machine is not fully downsized. To dice a workpiece with high efficiency, it is desired to dispose two cutting means, i.e., the first cutting means and the second cutting means, and make both of the first and second cutting means act on the single workpiece, as disclosed in the aforementioned Japanese Unexamined Patent Publication Nos. 1999-26402 and 1999-74228. However, particularly when the first and second cutting means are disposed, part of the first cutting means and/or the second cutting means locally protrudes, thus making it impossible to make the installation space for the machine sufficiently small. As is well known, the dicer usually needs to be placed in a so-called clean room. In this respect, too, it is strongly desired that the dicer be made as small as possible in size.

SUMMARY OF THE INVENTION

A principal object of the present invention is to improve the arrangement of the respective areas in a cutting machine, such as a dicer, to downsize the entire machine sufficiently.

Another object of the invention is to attain the principal object without causing problems such that a workpiece which has been cut and cleaned is recontaminated with swarf.

The inventor of the present invention conducted extensive studies. As a result, the inventor found that the above principal object could be achieved by placing the cassette bearing area, the chucking area, and the cleaning area in this order on a first straight line, which extends in a predetermined direction, in a plan view, and placing the chucking area and the cutting area on a second straight line, which extends substantially perpendicularly to the first straight line, in the plan view.

That is, the invention provides, as a cutting machine for attaining the principal object, a cutting machine comprising cassette supporting means, disposed in a cassette bearing area, for supporting a cassette accommodating a plurality of workpieces; a chuck table disposed substantially horizontally movably between a chucking area and a cutting area; cleaning means disposed in a cleaning area; cutting means for cutting the workpiece chucked on the chuck table located in the cutting area; and workpiece transport means, wherein:

the cassette bearing area, the chucking area, and the cleaning area are placed in this order on a first straight line, which extends in a predetermined direction, in a plan view, while the chucking area and the cutting area are placed on a second straight line, which extends substantially perpendicularly to the first straight line, in the plan view; and the workpiece accommodated in the cassette is carried out of the cassette to the chucking area by the workpiece transport means, chucked on the chuck table in the chucking area, conveyed to the cutting area together with the chuck table, cut by the cutting means in the cutting area, then returned to the chucking area together with the chuck table, transported from a site on the chuck table to the cleaning means by the workpiece transport means, cleaned by the cleaning means, then transported from the cleaning means to the chucking area by the workpiece transport means, and carried into the cassette by the workpiece transport means.

If desired, temporally supporting means for temporally supporting the workpiece may be disposed in the chucking area so that the workpiece to be cut, which has been carried out of the cassette, can be initially borne on the temporally supporting means, and then transported from a site on the temporally supporting means onto the chuck table, whereafter the workpiece which has been cut and cleaned can be transported from the cleaning means onto the temporally supporting means, and then carried into the cassette. Preferably, the temporally supporting means is composed of a pair of support members placed above the chuck table located in the chucking area, and the pair of support members are movable between an operating position at which the support members are located with a predetermined spacing from each other and the workpiece is borne by the support members in such a manner as to bridge the spacing between the support members, and a non-operating position at which the support members have been moved from the operating position away from each other and the workpiece is allowed to descend through the spacing between the support members.

To attain the other object stated earlier, it is preferred that the workpiece transport means includes first transport means, second transport means, and third transport means; the first transport means carries the workpiece to be cut, out of the cassette onto the temporally supporting means, and carries the workpiece, which has been transported onto the temporally supporting means after being cut and cleaned, from a site on the temporally supporting means into the cassette; the second transport means transports the workpiece to be cut, which has been carried out of the cassette and borne on the temporally supporting means, from a site on the temporally supporting means onto the chuck table, and transports the workpiece, which has been cut and cleaned, from the cleaning means onto the temporally supporting means; and the third transport means transports the workpiece, which has been returned to the chucking area together with the chuck table after being cut, from a site on the chuck table to the cleaning means.

In preferred embodiments, the workpiece comprises a semiconductor wafer, and the cutting means dices the semiconductor wafer. Preferably, the cutting means includes first cutting means and second cutting means; each of the first cutting means and the second cutting means has a rotating shaft, and a cutting blade mounted on the rotating shaft; the rotating shafts are located tandem and extend parallel to the first straight line; and the cutting blades are mounted on ends of the rotating shafts facing each other.

DETAILED DESCRIPTION OF THE PREFERRED EMBODIMENTS

A dicer as a preferred embodiment of a cutting machine constituted in accordance with the present invention will now be described in further detail with reference to the accompanying drawings.

Figure 1:
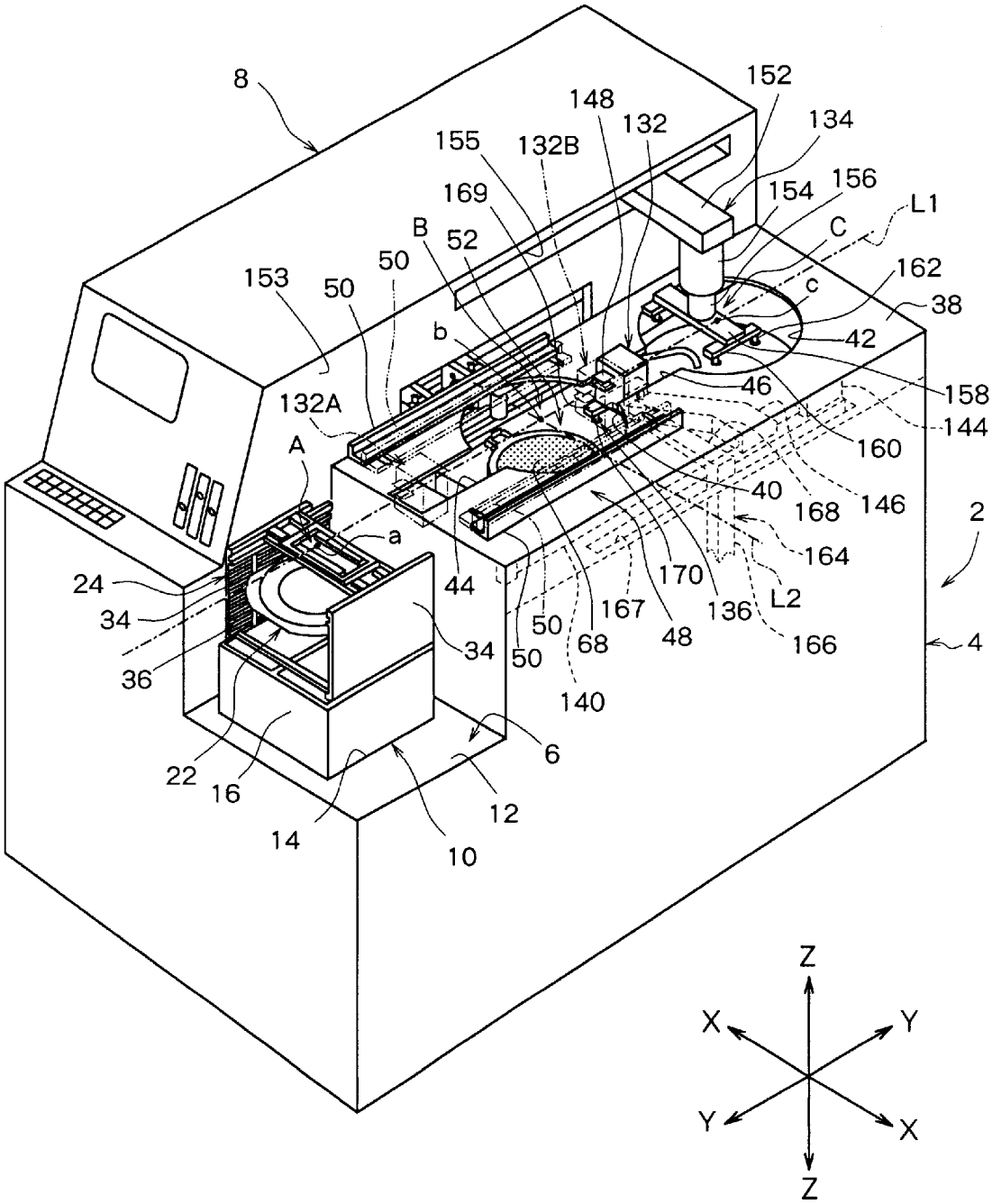
FIG. 1 is a perspective view showing a dicer as an embodiment of a cutting machine constituted in accordance with the present invention.

With reference to FIG. 1, the illustrated dicer has a housing designated entirely as the reference numeral 2. The housing 2 has a main portion 4 of a nearly rectangular parallelopipedal shape. In a front part of one half of the main portion 4, a sinking portion 6 of a nearly square shape is formed. In the other half of the main portion 4, an upwardly protruding portion 8 of a nearly rectangular parallelopipedal shape is formed. In the one half of the housing 2, a cassette bearing area A, a chucking area B, and a cleaning area C are placed in this order. The cassette bearing area A is located in the front part of the one half of the housing 2 (accordingly, in the sinking portion 6), the chucking area B is located in an intermediate part of the one half of the housing 2, and the cleaning area C is located in a rear part of the one half of the housing 2. It is important for the cassette bearing area A, the chucking area B, and the cleaning area C to be placed on a straight line extending substantially in a fore-and-aft direction in a plan view. More specifically, it is important for the center, a, of the cassette bearing area A, the center, b, of the chucking area B, and the center, c, of the cleaning area C to be placed on a straight line L1 extending substantially in the fore-and-aft direction in the plan view. In the protruding portion 8 formed in the other half of the housing 2, a cutting area D (see FIG. 2) is placed. In the plan view, a straight line passing through the cutting area D and the chucking area B, importantly, extends substantially perpendicularly to the straight line passing through the cassette bearing area A, the chucking area B, and the cleaning area C. More specifically, it is important that in the plan view, a straight line L2 passing through the center, d, of the cutting area D and the center, b, of the chucking area B is perpendicular to the straight line L1. For convenience of explanation, in the present specification, the direction of extension of the straight line L2 is called the X-axis direction, the direction of extension of the straight line L1 is called the Y-axis direction, and the vertical direction is called the Z-axis direction.

Figure 2:
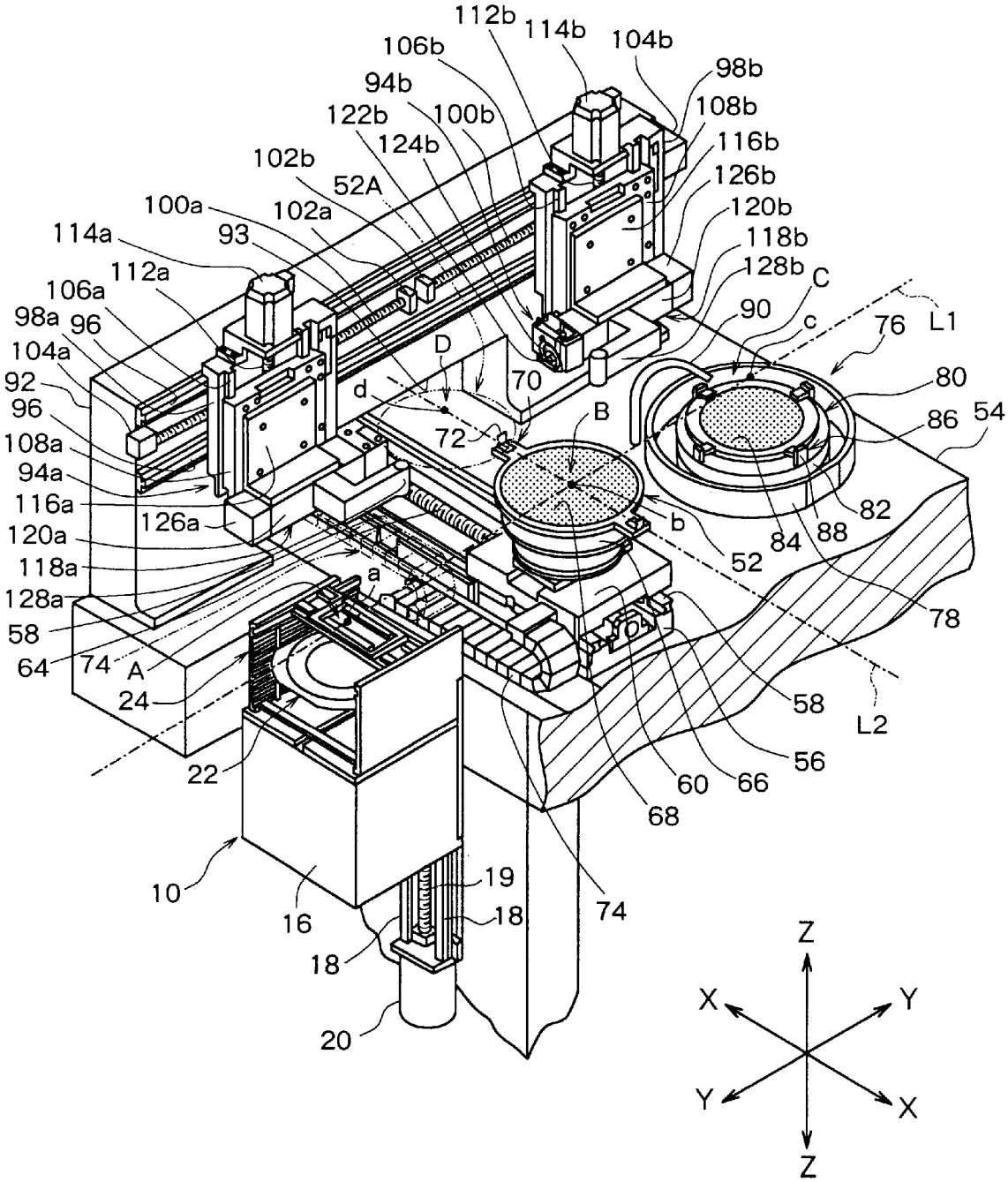
FIG. 2 is a perspective view showing a part of the dicer in FIG. 1, with a housing broken away.

Referring to FIG. 2 along with FIG. 1, cassette supporting means 10 is disposed in the cassette bearing area A. The cassette supporting means 10, which may have a well known shape, has an ascent/descent stand 16 to be moved up and down through an opening 14 formed in an upper wall 12 of the sinking portion 6 of the housing 2. As shown in FIG. 2, two guide rails 18 extending substantially vertically are fixed in the housing 2, and guided grooves (not shown) are formed in the ascent/descent stand 16. The guided grooves of the ascent/descent stand 16 are slidably engaged with the guide rails 18, whereby the ascent/descent stand 16 is mounted upwardly and downwardly movably along the guide rails 18. In the housing 2, an externally threaded shaft 19 extending substantially vertically is mounted rotatably, and an internally threaded member (not shown) screwed to the externally threaded shaft 19 is fixed to the ascent/descent stand 16. An electric motor 20 is coupled to the externally threaded shaft 19, and the externally threaded shaft 19 is rotated normally and reversely by the electric motor 20 to hoist and lower the ascent/descent stand 16.

Figure 3:
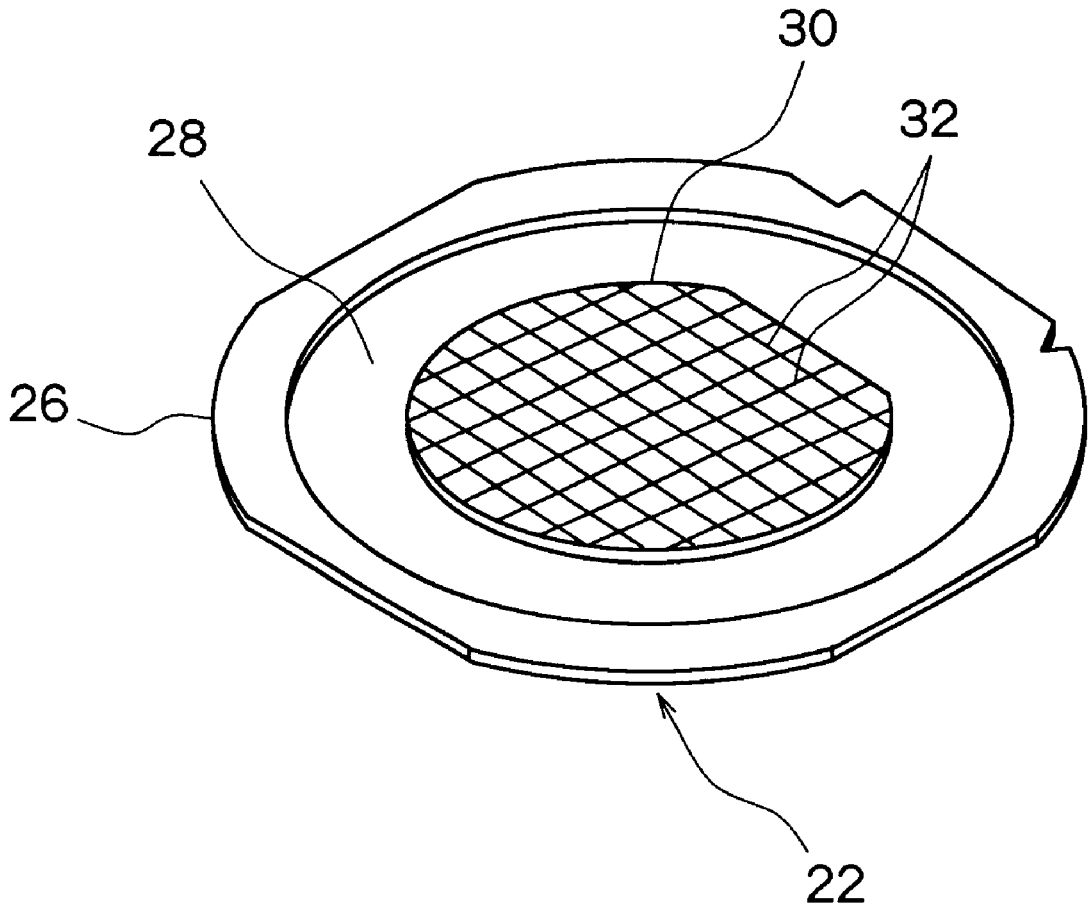
FIG. 3 is a perspective view showing a state in which a semiconductor wafer to be diced by the dicer of FIG. 1 is mounted on a frame via a mounting tape.

On the ascent/descent stand 16 of the cassette supporting means 10, a cassette 24 accommodating a plurality of workpieces 22 is borne. The workpiece 22 in the illustrated embodiment, as shown in FIG. 3, comprises a semiconductor wafer 30 mounted via a mounting tape 28 on a frame 26 having a mounting opening in the center. On the surface of the semiconductor wafer 30, cutting lines arranged in a lattice pattern, i.e., streets, 32, are formed. Each of rectangular areas demarcated by the streets 32 constitutes a chip forming an electronic circuit. The cassette 24 has a pair of side walls 34, and a plurality of accommodating grooves 36 extending horizontally with predetermined spacing in an up-and-down direction are formed in an inner surface of the side wall 34. The workpieces 22 are accommodated in such a manner as to extend substantially horizontally with predetermined spacing in the up-and-down direction, by inserting both side edge portions of each of the frames 26 into the accommodating grooves 36, as a pair, of the pair of side walls 34 (In FIGS. 1 and 2, only one workpiece 22 is illustrated for simplification of the drawings). By hoisting and lowering the ascent/descent stand 16, each pair of the accommodating grooves 36 of the cassette 24 are brought to a predetermined height. As will be further mentioned later on, the workpiece 22 to be cut is carried out of each pair of the accommodating grooves 36 positioned at the predetermined height. Then, the workpiece 22, which has been cut and cleaned, is carried again into the pair of accommodating grooves 36 located at the predetermined height.

As will be clearly illustrated in FIG. 1, relatively large circular openings 40 and 42 are formed in an upper wall 38 of the one half of the housing 2 in correspondence with the chucking area B and the cleaning area C, respectively. There are also formed a slender opening 44 extending in the Y-axis direction from the cassette bearing area A to the circular opening 40, and a slender opening 46 extending in the Y-axis direction from the circular opening 40 to the circular opening 42. In conjunction with the chucking area B, accordingly in conjunction with the circular opening 40, temporally supporting means 48 is disposed on the upper wall 38. The temporally supporting means 48 includes a pair of support members 50 disposed with spacing in the X-axis direction. The pair of support members 50 are mounted movably in the X-axis direction, and are selectively located at a non-operating position indicated by solid lines and an operating position indicated by two-dot chain lines in FIG. 1. As will be further stated later on, when the pair of support members 50 are located at the operating position, the workpiece 22 carried out of the cassette 24 is borne in such a manner as to bridge the spacing between the pair of support members 50 (in other words, both side edge portions of the frame 26 in the workpiece 22 are supported by the pair of support members 50). When the pair of support members 50 are moved away from each other to the non-operating position, it becomes possible to move the workpiece 22 up and down through the spacing between the pair of support members 50 and through the circular opening 40.

With reference to FIG. 2 along with FIG. 1, a chuck table 52 is disposed in the housing 2 substantially horizontally movably in the X-axis direction between the chucking area B and the cutting area D. In detail, a stationary support pedestal 54 extending substantially horizontally is disposed in the housing 2. On the support pedestal 54, a pair of support blocks 56 (only one of them is shown in FIG. 2) are fixed with spacing in the X-axis direction. Between the pair of support blocks 56, a pair of guide rails 58 extending in the X-axis direction are fixed with spacing in the Y-axis direction. On the pair of guide rails 58, a slide block 60 is mounted. On the lower surface of the slide block 60, a pair of guided grooves (not shown) extending in the X-axis direction are formed. The pair of guided grooves are engaged with the pair of guide rails 58, whereby the slide block 60 is mounted movably in the X-axis direction along the guide rails 58. Between the pair of support blocks 56, an externally threaded shaft 64 extending in the X-axis direction is also mounted movably. On the lower surface of the slide block 60, an internally threaded member (not shown) is fixed. The internally threaded member is screwed to the externally threaded shaft 64. An electric motor (not shown) is coupled to the externally threaded shaft 64, and the electric motor is normally and reversely rotated to move the slide block 60 along the guide rails 58 in the X-axis direction. On the slide block 60, a cylindrical support member 66 is fixed. On the support member 66, a chuck member 68 is mounted rotatably about a central axis extending substantially vertically. In the support member 66, a rotational drive source (not shown), optionally an electric motor, for rotating the chuck member 68 is disposed. The chuck member 68 in the shape of a disk is formed of a porous material such as a porous ceramic. The chuck member 68 is provided with a pair of grip mechanisms 70 protruding in the X-axis direction. Each of the grip mechanisms 70 includes a movable grip piece 72, and the movable grip piece 72 is selectively brought by actuating means (not shown), such as an air actuator, to a non-gripping position illustrated in FIG. 2, and a gripping position inward of the non-gripping position in a turning direction. When the chuck table 52 is positioned in the chucking area B as shown in FIG. 2, the chuck member 68 is positioned in alignment with the opening 40 formed in the upper wall 38 of the housing 2. The slide block 60 is provided with a hollow protective duct 74 suitably deformable from a state indicated by solid lines to a state indicated by two-dot chain lines in FIG. 2, and vice versa, in accordance with the movement of the slide block 60. The chuck member 68 formed of the porous material is caused to selectively communicate with a suitable suction source (not shown) via the support member 66, the slide block 60, and a suction path (not shown) disposed in the hollow protective duct 74. An electric wiring for the actuating means, which moves the movable grip piece 72 of the grip mechanism 70, also stretches within the support member 66, the slide block 60, and the hollow protective duct 74.

In the cleaning area C, cleaning means 76 is disposed. As will be clearly illustrated in FIG. 2, the cleaning means 76, which may be of a well known form per se, includes a cylindrical bulkhead 78 fixed on the support pedestal 54, and a chucking mechanism 80 rotatably disposed inward of the bulkhead 78. The chucking mechanism 80 includes an ascent/descent stand 82 which is moved up and down between an ascending position shown in FIG. 2 and a descending position lowered from the ascending position by a predetermined amount. On the upper end of the ascent/descent stand 82, a disk-shaped chuck member 84 is fixed. The chuck member 84 is formed of a porous material such as a porous ceramic, and is caused to selectively communicate with a suitable suction source (not shown) via a suction path (not shown) disposed in the ascent/descent stand 82. On the ascent/descent stand 82, four grip mechanisms 86 arranged around the chuck member 84 are disposed. Each of the grip mechanisms 86 includes a movable grip piece 88, and the movable grip piece 88 is selectively brought by actuating means (not shown), such as an electromagnetic solenoid, to a non-gripping position illustrated in FIG. 2, and a gripping position inward of the non-gripping position in a turning direction. The cleaning means 76 includes a jetting nozzle 90 for jetting a cleaning liquid which may be deionized water. The jetting nozzle 90 has a base portion extending substantially vertically upwardly from the support pedestal 54, and a curved portion extending in a nearly U-shape from the base portion. As will be further mentioned later on, during a cleaning operation, the cleaning liquid is jetted from the tip of the jetting nozzle 90 toward the workpiece 22 attracted onto the chuck member 84. On this occasion, the jetting nozzle 90 can be turned in a reciprocating manner about a central axis of the base portion of the jetting nozzle 90. The chuck member 84 of the cleaning means 76 is positioned in alignment with the aforementioned opening 42 (FIG. 1) formed in the upper wall 38 of the housing 2.

Mainly with reference to FIG. 2, an upright support base plate 92 extending in the Y-axis direction is fixed on the support pedestal 54. In the center of the support base plate 92, a relatively large notch 93 is formed for accepting the chuck table 52. On the support base plate 92, a pair of cutting means, i.e., first cutting means 94*a* and second cutting means 94*b*, are mounted. In further detail, a pair of guide rails 96 extending in the Y-axis direction with spacing in the up-and-down direction are disposed on the inner surface of the support base plate 92. On the outer surfaces of a slide block 98*a* of the first cutting means 94*a* and a slide block 98*b* of the second cutting means 94*b*, a pair of guided grooves (not shown) extending in the Y-axis direction are formed. The pair of guided grooves are engaged with the pair of guide rails 96, whereby the slide block 98*a* and the slide block 98*b* are mounted on the pair of guide rails 96 slidably in the Y-axis direction. On the front surface of the support base plate 92, externally threaded shafts 100*a* and 100*b* extending in the Y-axis direction are rotatably mounted via bearing members 102*a* and 102*b*. The externally threaded shafts 100*a* and 100*b* are placed on a straight line. On the rear surfaces of the slide blocks 98*a* and 98*b*, internally threaded members (not shown) are fixed, and such internally threaded members are screwed to the externally threaded shafts 100*a* and 100*b*, respectively. To the externally threaded shafts 100*a* and 100*b*, electric motors 104*a* and 104*b* are connected, respectively. When the externally threaded shafts 100*a* and 100*b* are rotated by the electric motors 104*a* and 104*b*, the slide blocks 98*a* and 98*b* are moved in the Y-axis direction along the pair of guide rails 96. On the front surface of each of the slide blocks 98*a* and 98*b*, a pair of guide rails 106*a* and a pair of guide rails 106*b*, which extend substantially vertically, namely, in the Z-axis direction, are disposed with spacing in the Y-axis direction. On each of the outer surfaces of ascent/descent blocks 108*a* and 108*b*, a pair of guided grooves extending in the Z-axis direction are formed. By engaging the pair of guided grooves with the pair of guide rails 106*a* and 106*b*, the ascent/descent blocks 108*a* and 108*b* are mounted on the slide blocks 98*a* and 98*b* upwardly and downwardly movably in the Z-axis direction. On the slide blocks 98*a* and 98*b*, externally threaded shafts 112*a* and 112*b* extending in the Z-axis direction are further mounted rotatably. On the rear surfaces of the ascent/descent blocks 108*a* and 108*b*, internally threaded members (not shown) are fixed. These internally threaded members are screwed to the externally threaded shafts 112*a* and 112*b*, respectively. To the externally threaded shafts 112*a* and 112*b*, electric motors 114*a* and 114*b* are connected, respectively. When the externally threaded shafts 112*a* and 112*b* are rotated by the electric motors 114*a* and 114*b*, the ascent/descent blocks 108*a* and 108*b* are moved upward and downward along the pair of guide rails 110*a* and 110*b*.

On the ascent/descent blocks 108*a* and 108*b*, cutting units 118*a* and 118*b* are mounted, respectively, via coupling brackets 116*a* and 116*b*. The cutting units 118*a* and 118*b* include cases 120*a* and 120*b* of a nearly rectangular parallelopipedal shape. In each of the cases 120*a* and 120*b*, a rotating shaft extending in the Y-axis direction is mounted rotatably (only a rotating shaft 122*b* mounted in the case 120*b* is shown in FIG. 2). Such rotating shafts are arranged in tandem. To the inner ends of the rotating shafts, i.e., the ends facing each other, cutting blades are fixed (only a cutting blade 124*b* fixed to the rotating shaft 122*b* is shown in FIG. 2). The cutting blade can be composed of a thin disk containing diamond abrasive grains. To the outer ends of the rotating shafts 122*a* and 122*b*, electric motors 126*a* and 126*b* are connected. The cases 120*a* and 120*b* are also equipped with imaging means 128*a* and 128*b* including microscopes.

With reference to FIG. 1, the illustrated dicer also has first transport means 132, second transport means 134, and third transport means 136. In regard to the first transport means 132, a guide rail (not shown) extending in the Y-axis direction is fixed on the aforementioned support pedestal 54, and an externally threaded shaft 140 extending in the Y-axis direction is mounted rotatably. To an end of the externally threaded shaft 140, an electric motor 144 is connected. The first transport means 132 includes a slide arm 146. In the slide arm 146, there are formed a guided groove (not shown) extending in the Y-axis direction, and an internally threaded hole (not shown) extending in the Y-axis direction. By engaging the guided groove with the above guide rail, and screwing the internally threaded hole on the externally threaded shaft 140, the slide arm 146 is mounted slidably in the Y-axis direction. When the externally threaded shaft 140 is rotated by the electric motor 144, the slide arm 146 is slid in a reciprocating manner in the Y-axis direction. To the front end of the slide arm 146, grip means 148 is mounted. The grip means 148 has a pair of grip pieces for selectively gripping an edge portion of the frame 26 in the workpiece 22.

The second transport means 134 has a slide arm 152. In one-side wall 153 of the protruding portion 8 in the housing 2, a slot 155 extending slenderly in the Y-axis direction is formed. The slide arm 152 extends through the slot 155. In the protruding portion 8, a base portion of the slide arm 152 is mounted slidably in the Y-axis direction by the same mounting and driving means (not shown to avoid complicacy of the drawing) as mounting and driving means concerned with the slide arm 146 of the first transport means 132. The base portion of the slide arm 152 is slid in a reciprocating manner in the Y-axis direction by the normal rotation and reverse rotation of an electric motor. On the lower surface of a front end portion of the slide arm 152, a support member 154 is fixed. An ascent/descent member 156 is mounted to the support member 154. Between the support member 154 and the ascent/descent member 156, hoisting/lowering means (not shown), which may be a pneumatic cylinder mechanism, is interposed. The ascent/descent member 156 is hoisted and lowered by the hoisting/lowering means. To the lower end of the ascent/descent member 156, a plate-like member 158 extending in the X-axis direction is fixed. To both ends of the connecting member 158, plate-like members 160 extending in the Y-axis direction are fixed. On both ends of the lower surface of each of the plate-like member 160, attracting instruments 162 are mounted. Each of the attracting instruments 162 is caused to selectively communicate with a suction source (not shown) via a suitable suction path (not shown).

The third transport means 136 includes a support arm 164, and the support arm 164 has a vertical portion 166 extending substantially vertically, and a horizontal portion 168 extending substantially horizontally from the upper end of the vertical portion 166. In the support pedestal 54, an elongated slot 167 extending in the Y-axis direction is formed. The vertical portion 166 of the support arm 164 extends downward through the slot 167. In a lower part of the housing 2, a slide block (not shown for simplification of the drawing) is disposed. A lower end portion of the vertical portion 166 of the support arm 164 is mounted upwardly and downwardly movably on the slide block, and hoisting/lowering means (not shown) for hoisting and lowering the support arm 164 is also disposed. The manner of mounting the vertical portion 166 of the support arm 164 may be by a form including a guide rail and a guided groove to be engaged therewith. The hoisting/lowering means for the support arm 164 may be a form including an externally threaded shaft, and an internally threaded member screwed thereon. The slide block on which the vertical portion 166 of the support arm 164 is mounted is itself mounted movably in the Y-axis direction, and slide means for sliding the slide block in the Y-axis direction is also disposed. The manner of mounting the slide block may be by a form including a guide rail and a guided groove to be engaged therewith. The slide means for the slide block may be a form including an externally threaded shaft, and an internally threaded member screwed thereon. According to this constitution, the support arm 164 is slid in the Y-axis direction, and is also slightly moved up and down in the vertical direction, i.e., the Z-axis direction. At the front end of the support arm 164, a protruding piece 169 extending in the Y-axis direction is formed. On both ends of the lower surface of the protruding piece 169, attracting instruments 170 are mounted. Each of the attracting instruments 170 is caused to selectively communicate with a suction source (not shown) via a suitable suction path (not shown).

The actions of the above-described dicer will be summarized. The ascent/descent stand 16 of the cassette supporting means 10 is raised (or lowered) to a required height, and a specific one of the plurality of workpieces 22 accommodated in the cassette 24 borne on the ascent/descent stand 16 is positioned at a predetermined height. In such a state, the first transport means 132 is moved to a position indicated by two-dot chain lines 132A in FIG. 1. The grip means 148 of the first transport means 132 is actuated to grip an edge portion of the frame 26 in the specific workpiece 22 inside the cassette 24. Then, the first transport means 132 is moved to a position indicated by two-dot chain lines 132B in FIG. 1. In accordance with this movement, the workpiece 22 gripped by the grip means 148 is moved on the pair of support members 50 of the temporally supporting means 48, which are located at the operating position shown by two-dot chain lines in FIG. 1, from the cassette bearing area A to the chucking area B. Thus, the workpiece 22 is positioned on the temporally supporting means 48 in the chucking area B. Then, the grip means 148 of the first transport means 132 is released from the workpiece 22, and the first transport means 132 is moved to a waiting position indicated by solid lines. On this occasion, the second transport means 134 is moved in the Y-axis direction to the chucking area B. In the chucking area B, a suction instrument 162 is lowered, and brought into intimate contact with the frame 26 of the workpiece 22. Then, the suction instrument 162 is caused to communicate with the suction source to attract the workpiece 22 to the suction instrument 162. Then, the pair of support members 50 of the temporally supporting means 48 are brought to the non-operating position indicated by solid lines, and retreated from below the workpiece 22. Then, the suction instrument 162 of the second transport means 134 is lowered, and the workpiece 22 attracted to the suction instrument 162 is positioned on the chuck member 68 of the chuck table 52. Then, the chuck member 68 is caused to communicate with the suction source, whereby the semiconductor wafer 30 in the workpiece 22 is attracted onto the chuck member 68. Also, the movable grip pieces 72 of the pair of grip mechanisms 70 provided on the chuck member 68 are brought to the gripping position to grip the frame 26. The attracting instrument 162 of the second transport means 134 is cut off from the suction source to release the workpiece 22, and is then raised.

Then, the chuck table 52 is moved to a position indicated by a two-dot chain line 52A in FIG. 2. In the cutting units 118*a* and 118*b*, the microscopes of the appended imaging means 128*a* and 128*b* are brought to a position facing the surface of the semiconductor wafer 30 on the chuck member 68. An image of the surface of the semiconductor wafer 30 is photographed. Based on this image, the semiconductor wafer 30 on the chuck member 68 is sufficiently precisely aligned with the cutting blade (not shown) of the first cutting means 94*a* and the cutting blade 124*b* of the second cutting means 94*b*. At the time of this alignment, the chuck member 68 is moved in the X-axis direction where necessary, and is rotated about its central axis. Then, the chuck table 52 is moved to the cutting area D, where dicing of the semiconductor wafer 30 attracted onto the chuck member 68 is performed. During this dicing, the chuck member 68 is moved in the X-axis direction, and the cutting blade of the first cutting means 94*a* and the cutting blade 124*b* of the second cutting means 94*b* are applied to the semiconductor wafer 30, simultaneously or with some time difference, to cut the semiconductor wafer 30 along the streets 32 extending in the X-axis direction. The cutting unit 118*a* of the first cutting means 94*a* and the cutting unit 118*b* of the second cutting means 94*b* are positioned at a required height, and periodically indexed in the Y-axis direction. Upon completion of the cutting along the streets 32 extending in the X-axis direction, the chuck member 68 is turned through 90 degrees. Then, cutting along the streets 32 extending in the Y-axis direction is started anew. In this manner, the semiconductor wafer 30 on the chuck member 68 is cut along the streets 32 arranged in the lattice pattern. The mounting tape 28 interposed between the frame 26 and the semiconductor wafer 30 is not cut, so that after cutting of the semiconductor wafer 30, the frame 26, the mounting tape 28, and the diced semiconductor wafer 30 are maintained integrally.

When the chuck table 52 is returned to the chucking area B, the third transport means 136, which has been located at the waiting position shown in FIG. 1, is moved in the Y-axis direction to the chucking area B, simultaneously with or after returning of the chuck table 52. Then, the third transport means 136 is slightly lowered to bring its attracting instrument 170 into intimate contact with the frame 26 of the workpiece 22. The attracting instrument 170 is caused to communicate with the suction source, whereby the workpiece 22 is attracted to the attracting instrument 170. At the same time, the chuck member 68 is cut off from the suction source to release the attraction of the semiconductor wafer 30 onto the chuck member 68. Also, the movable grip pieces 72 of the pair of grip mechanisms 70 provided on the chuck member 68 are returned to the non-gripping position to release the gripping of the frame 26. Then, the third transport means 136 is somewhat moved upward, and moved in the Y-axis direction below the first transport means 132 as far as the cleaning area C. Then, the third transport means 136 is lowered, whereupon the workpiece 22 attracted to the attracting instrument 170 is borne on the chuck member 84 in the cleaning means 76. The chuck member 84 is caused to communicate with the suction source, whereby the workpiece 22 is attracted onto the chuck member 84. At the same time, the attracting instrument 170 of the third transport means 136 is cut off from the suction source to release the workpiece 22 from the attracting instrument 170. Then, the third transport means 136 is somewhat raised, and then moved in the Y-axis direction to the waiting position. In the cleaning area C, the chuck member 84 having the workpiece 22 attracted thereto is caused to communicate with the suction source, whereby the semiconductor wafer 30 is attracted onto the chuck member 84. Also, the movable grip pieces 88 of the grip mechanisms 86 provided on the chuck member 84 are brought to the gripping position to grip the frame 26. Then, the chuck member 84 having the workpiece 22 attracted thereto is lowered to a required position. The jetting nozzle 90 is turned in a reciprocating manner, and a cleaning liquid which may be deionized water is jetted from the jetting nozzle 90 toward the workpiece 22. Moreover, the chuck member 84 is rotated at a speed of about 600 rpm. In this manner, the workpiece 22, which swarf formed by cutting adheres to, is cleaned. Then, jetting of the cleaning liquid from the jetting nozzle 90 is stopped, and the chuck member 84 is rotated at a speed of about 3,000 rpm for spin drying of the workpiece 22.

After cleaning is completed, the chuck member 84 is raised to the position shown in FIG. 2. Then, the chuck member 84 is cut off from the suction source to release the attraction of the semiconductor wafer 30. Also, the movable grip pieces 88 of the grip mechanisms 86 are returned to the non-gripping position to release the gripping of the frame 26, thereby releasing the holding of the workpiece 22 by the chuck member 84. At this time, the second transport means 134 is moved in the Y-axis direction to the cleaning area C. Then, the attracting instrument 162 of the second transport means 134 is lowered to come into intimate contact with the frame 26 in the workpiece 22. Then, the attracting instrument 162 is caused to communicate with the suction source, whereby the workpiece 22 is attracted to the attracting instrument 162. Then, the attracting instrument 162 of the second transport means 134 is raised to a required height, and moved in the Y-axis direction to the chucking area B. Then, the attracting instrument 162 of the second transport means 134 is lowered, and placed in such a manner as to bridge the spacing between the pair of support members 50 of the temporally supporting means 48 located at the operating position indicated by the two-dot chain line in FIG. 1. Then, the attracting instrument 162 is cut off from the suction source to release the workpiece 22 from the attracting instrument 162. Then, the attracting instrument 162 is raised.

When the workpiece 22, which has been cut and cleaned in the above manner, is placed on the temporally supporting means 48, the first transport means 132 is moved from the waiting position indicated by the solid lines in FIG. 1 to the position indicated by the two-dot chain lines 132B in FIG. 1. The grip means 150 of the first transport means 132 is actuated to grip an edge portion of the frame 26 in the workpiece 22 on the temporally supporting means 48. Then, the first transport means 132 is moved to the position indicated by the two-dot chain lines 132A in FIG. 1, whereby the workpiece 22 is inserted into the cassette 24. Then, the grip means 150 of the first transport means 132 is released from the workpiece 22, and the first transport means 132 is returned to the waiting position indicated by the solid lines.

While the preceding workpiece 22 is being cleaned in the cleaning area C, the next workpiece 22 to be cut, which has been accommodated in the cassette 24, is carried out of the cassette 24 onto the temporally supporting means 48. Then, this workpiece 22 to be cut is chucked onto the chuck table 52. After required alignment together with the chuck table 52, the workpiece 22 is transported to the cutting area D. In the cutting area D, cutting with the first cutting means 94*a* and the second cutting means 94*b* can be initiated.

In the above-described dicer, the first cutting means 94*a* and the second cutting means 94*b* for cutting the workpiece 22 in the cutting area D are arranged advantageously together with the cassette bearing area A, the chucking area B, the cleaning area C, and the cutting area D. Thus, attention should be paid to the fact that the entire dicer is constituted to be compact. Particular attention should be paid to the facts that as compared with the dicers disclosed in Japanese Unexamined Patent Publication Nos. 1999-26402 and 1999-74228, there is no portion locally protruding, there is no need to dispose a so-called waiting area, and in these respects as well, compactness of the machine has been achieved. Furthermore, only the third transport means 136 is used to transport the workpiece after cutting but before cleaning, i.e., the workpiece having swarf adhering thereto. On the other hand, to transport the workpiece before cutting and after cleaning, i.e., the workpiece having no swarf adhering thereto, the third transport means 136 is not used, but the first transport means 132 and the second transport means 134 are use. Hence, swarf is not transferred, via the transport means, to the workpiece before cutting and after cleaning. This should also be given attention.

A specific dicer as a preferred embodiment of the cutting machine constituted in accordance with the present invention has been described in detail with reference to the accompanying drawings. It should be understood that the invention is not restricted to such a dicer, but various changes and modifications may be made without departing from the spirit and scope of the invention.

What I claim is:

1. A cutting machine comprising cassette supporting means, disposed in a cassette bearing area, for supporting a cassette accommodating a plurality of workpieces; a chuck table disposed substantially horizontally movably between a chucking area and a cutting area; cleaning means disposed in a cleaning area; cutting means for cutting the workpiece chucked on the chuck table located in the cutting area; and workpiece transport means, wherein:

the cassette bearing area, the chucking area, and the cleaning area are placed in this order on a first straight line, which extends in a predetermined direction, in a plan view, while the chucking area and the cutting area are placed on a second straight line, which extends substantially perpendicularly to the first straight line, in the plan view; and the workpiece accommodated in the cassette is carried out of the cassette to the chucking area by the workpiece transport means, chucked on the chuck table in the chucking area, conveyed to the cutting area together with the chuck table, cut by the cutting means in the cutting area, then returned to the chucking area together with the chuck table, transported from a site on the chuck table to the cleaning means by the workpiece transport means, cleaned by the cleaning means, then transported from the cleaning means to the chucking area by the workpiece transport means, and carried into the cassette by the workpiece transport means.

2. The cutting machine claimed in claim 1, wherein:

temporally supporting means for temporally supporting the workpiece is disposed in the chucking area;

the workpiece to be cut, which has been carried out of the cassette, is initially borne on the temporally supporting means, and then transported from a site on the temporally supporting means onto the chuck table; and the workpiece which has been cut and cleaned is transported from the cleaning means onto the temporally supporting means, and then carried into the cassette.

3. The cutting machine claimed in claim 2, wherein:

the temporally supporting means is composed of a pair of support members placed above the chuck table located in the chucking area, and the pair of support members are movable between an operating position at which the support members are located with a predetermined spacing from each other and the workpiece is borne by the support members in such a manner as to bridge the spacing between the support members, and a non-operating position at which the support members have been moved from the operating position away from each other and the workpiece is allowed to descend through the spacing between the support members.

4. The cutting machine claimed in claim 2, wherein:

the workpiece transport means includes first transport means, second transport means, and third transport means;

the first transport means carries the workpiece to be cut, out of the cassette onto the temporally supporting means, and carries the workpiece, which has been transported onto the temporally supporting means after being cut and cleaned, from a site on the temporally supporting means into the cassette;

the second transport means transports the workpiece to be cut, which has been carried out of the cassette and borne on the temporally supporting means, from a site on the temporally supporting means onto the chuck table, and transports the workpiece, which has been cut and cleaned, from the cleaning means onto the temporally supporting means; and the third transport means transports the workpiece, which has been returned to the chucking area together with the chuck table after being cut, from a site on the chuck table to the cleaning means.

5. The cutting machine claimed in claim 1, wherein:

the workpiece comprises a semiconductor wafer, and the cutting means dices the semiconductor wafer.

6. The cutting machine claimed in claim 5, wherein:

the cutting means has a rotating shaft, and a cutting blade mounted on the rotating shaft; and the rotating shaft extends parallel to the first straight line.

7. The cutting machine claimed in claim 5, wherein:

the cutting means includes first cutting means and second cutting means; each of the first cutting means and the second cutting means has a rotating shaft, and a cutting blade mounted on the rotating shaft; the rotating shafts are located tandem and extend parallel to the first straight line; and the cutting blades are mounted on ends of the rotating shafts facing each other.

* * * * *